United States Patent [19]

Zylbert

[11] Patent Number: 4,475,475

[45] Date of Patent: Oct. 9, 1984

[54] GEAR ATTACHING ARRANGEMENT FOR LOOPTAKER DRIVE SHAFT

[75] Inventor: Thaddeus J. Zylbert, Morris Plains, N.J.

[73] Assignee: The Singer Company, Stamford, Conn.

[21] Appl. No.: 474,220

[22] Filed: Mar. 11, 1983

[51] Int. Cl.[3] ..... D05B 57/32

[52] U.S. Cl. ..... 112/228; 403/362

[58] Field of Search ..... 112/181, 182, 183, 184, 112/191, 228, 230, 186 (U.S. only); 403/362, 366, 372

[56] References Cited

U.S. PATENT DOCUMENTS

| | | | |
|---|---|---|---|
| 376,900 | 1/1988 | Morell . | |
| 2,170,545 | 8/1939 | Burton . | |
| 3,023,034 | 2/1962 | Chung | 403/366 |
| 3,362,815 | 1/1968 | Sikorski . | |
| 3,380,413 | 4/1968 | Kuramochi | 112/181 X |
| 3,598,432 | 8/1971 | Walker | 403/366 |
| 3,693,566 | 9/1972 | Ketterer | 112/184 |
| 3,994,608 | 11/1976 | Swiderski et al. | 403/372 |
| 4,067,658 | 1/1978 | Ueno et al. | 403/372 X |
| 4,110,054 | 8/1978 | Moeller, Jr. | 403/373 |
| 4,168,636 | 9/1979 | Kocher | 403/368 X |
| 4,334,714 | 6/1982 | Gargrave | 403/367 X |
| 4,355,590 | 10/1982 | Ketterer | 112/184 |

FOREIGN PATENT DOCUMENTS

| | | | |
|---|---|---|---|
| 578664 | 6/1958 | Italy | 112/228 |

*Primary Examiner*—Wm. Carter Reynolds

*Attorney, Agent, or Firm*—William V. Ebs; Robert E. Smith; Edward L. Bell

[57] ABSTRACT

A hollow looptaker shaft which has a spindle rotatable therein and which is of a material susceptible to local deformation under pressure is fitted with a steel sleeve that is prevented from rotating relative to the shaft, and a gear for use in rotating the shaft is affixed to the sleeve with a set screw.

4 Claims, 3 Drawing Figures

GEAR ATTACHING ARRANGEMENT FOR LOOPTAKER DRIVE SHAFT

BACKGROUND OF THE INVENTION

1. Field of the Invention

The invention relates to sewing machine looptakers, and more particularly to arrangements for affixing a drive gear to a looptaker shaft.

2. Description of the Prior Art

It has been a common practice to secure a drive gear directly to the depending shaft of a sewing maching looptaker with a set screw as in the manner shown for example, in U.S. Pat. No. 3,242,891 for "Stitch Forming Drive Mechanism" of E. W. Bialy, issued Mar. 29, 1966, and in U.S. Pat. No. 3,693,566 for "Bobbin Thread Replenishing Mechanism for Sewing Machines" of S. J. Ketterer, issued Sept. 26, 1972.

In sewing machines provided with bobbin replenishing mechanism including a rotatable spindle within a hollow looptaker shaft as disclosed in the aforementioned U.S. Pat. No. 3,693,566, the use of a set screw for affixing a gear to the looptaker shaft is feasable if the shaft is of a material such as steel which is sufficiently resistant to deformation under the screw to prevent the shaft from being indented by the screw and interfering with the operation of the spindle. However, it is often desirable to use a material such as zinc or a plastic which is less resistant to localized pressure and with which the looptaker and shaft can be cheaply cast or molded into an integral structure requiring little or no machining.

It is a prime object of the present invention to provide the means for affixing a gear to a locally deformable cast or molded hollow looptaker shaft without affecting the freedom of movement of a spindle within the shaft.

It is another object of the invention to provide an arrangement enabling a drive gear to be secured to a hollow looptaker shaft with the turn of a set screw and without applying a localized pressure to the shaft under the screw.

Other objects and advantages of the invention will become apparent during a reading of the specification taken in connection with the accompanying drawings.

SUMMARY OF THE INVENTION

A hollow looptaker shaft of a material which would be locally deformable under the pressure of a screw forcibly bearing against it, is provided with a flat exterior surface. A longitudinally split sleeve with a flat interior surface is fitted onto the shaft so as to effect engagement of the flat surfaces one with the other, and prevent relative turning of the sleeve and shaft. A gear is affixed to the sleeve with a set screw extending through the gear to engage the sleeve. The set screw by bearing tightly against the sleeve causes the split sleeve to contract and grip the shaft, the consequence of which is that both the gear and sleeve are prevented from moving relative to the shaft. No deformation of the hollow looptaker shaft occurs and a spindle may move freely within the shaft without interference.

DESCRIPTION OF THE PREFERRED EMBODIMENT OF THE INVENTION

Figure 1:
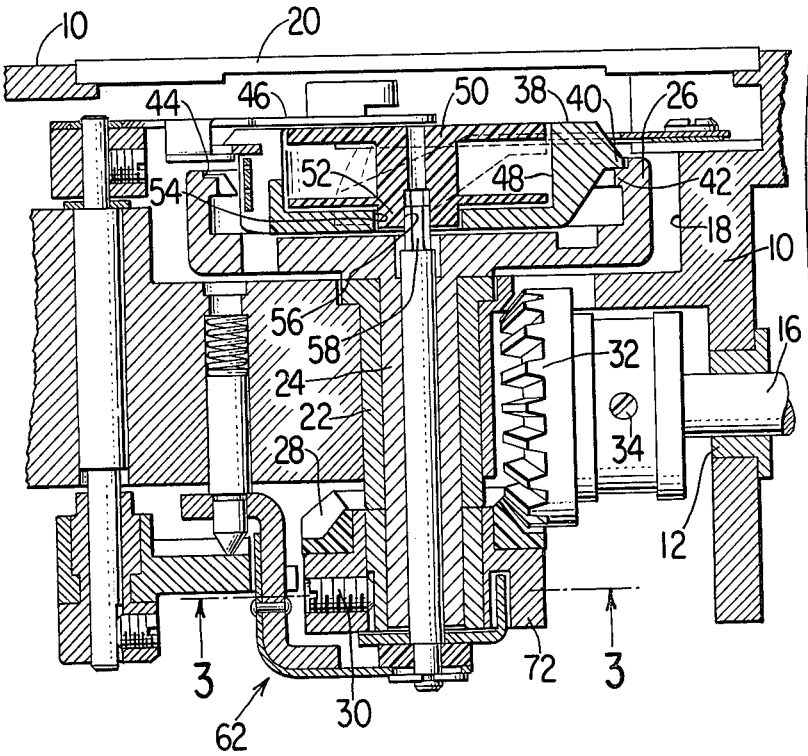
FIG. 1 is a fragmentary vertical sectional view taken longitudinally through a sewing machine bed, and showing a rotary looptaker and drive gear assembly according to the invention.

Referring to the drawings and in particular to FIG. 1, reference character 10 designates the bed of a sewing machine frame carrying a bushing 12 in which a horizontal bed shaft 16 is journalled for rotation. As shown, the bed is formed with an upwardly open looptaker accommodating cavity 18 closed by a slide cover plate 20. Rotatable in a bushing 22 carried in the bed is a hollow looptaker shaft 24 which depends from the underside of a rotary looptaker 26 disposed in the cavity 18. The looptaker shaft and rotary looptaker are driven during operation of the sewing machine by a bevel gear 28 made fast on the looptaker shaft with a set screw 30 and sleeve 31 as described hereinafter. Gear 28 meshes with a bevel gear 32 secured by a set screw 34 to the bed shaft 16.

Constrained within the looptaker is a conventional bobbin case indicated generally at 38. As shown, the bobbin case is formed with a bearing flange 40 which rests upon a bearing rib 42 of the looptaker and is constrained radially against a bearing shoulder 44. The bobbin case is held down in the looptaker by a spring arm 46 and is prevented from rotation by suitable means (not shown).

Within a cavity 48 of the bobbin case there is shown a fully rotatable bobbin which is generally indicated at 50. The bobbin is formed with a depending boss 52 that fits into a central aperture 54 of the bobbin case. The boss 52 is formed with a hexagonal aperture 56 to match the hexagonal extremity 58 of a rotatable spindle 60 extending through hollow shaft 24. The spindle may be raised to introduce extremity 58 into aperture 56 when it is desired to drive the bobbin to replenish thread thereon. Spindle 60 is part of bobbin thread replenishing mechanism generally indicated by reference character 62. The bobbin thread replenishing mechanism is of the kind shown, for example, in the aforementioned U.S. Pat. No. 3,693,566.

Gear 28 is attached to the hollow looptaker shaft 24 in the manner of the invention to prevent the shaft from being deformed in the process and interfering with the freedom of movement of the spindle 60 mounted therein. As noted hereinbefore, gear 28 is made fast on the looptaker shaft with set screw 30 and sleeve 31.

Figure 2:
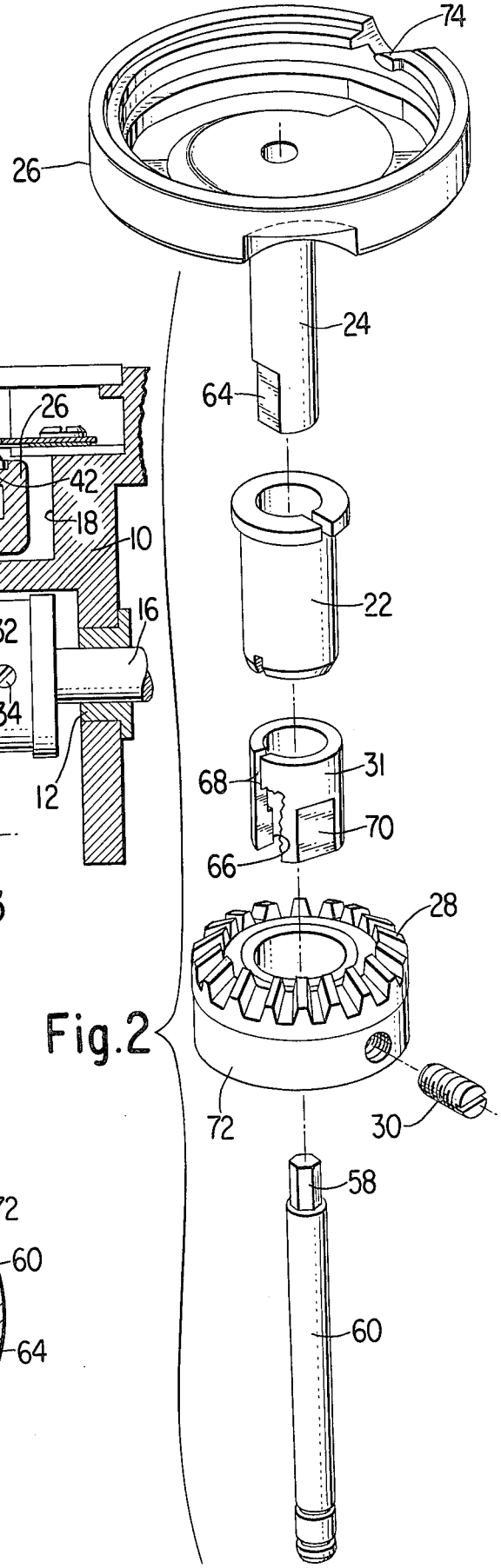
FIG. 2 is an exploaded perspective view showing the said looptaker and drive gear assembly.
Figure 3:
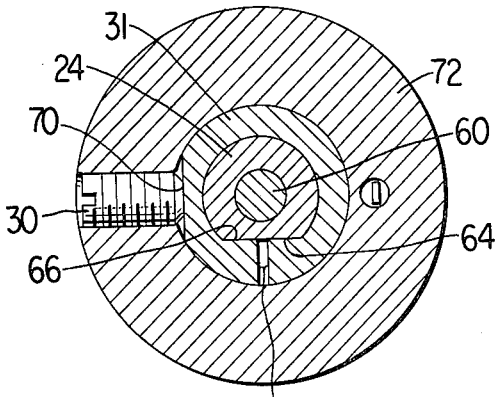
FIG. 3 is a sectional view taken on the plane of the line 3—3 of FIG. 1.

Referring to FIGS. 2 and 3, it may be seen that the lower end portion of shaft 24 is formed with an exterior planar surface 64. Sleeve 31 is formed with a matching interior planar surface 66, and is mounted upon shaft 24 with the surface 66 in engagement with surface 64 to prevent relative rotation of the sleeve and shaft. The sleeve is split radially by a small gap 68 extending longitudinally throughout the entire length of the sleeve and passing centrally through planar surface 66. An end portion of the sleeve is provided with an exterior planar surface 70 extending substantially parallel to a radial line through the gap 68. Gear 28 is mounted upon sleeve 31 with set screw 30 extending through the hub portion 72 of the gear and bearing against planar surface 70. The screw not only secures the gear on the sleeve, but also affixes the sleeve to the shaft by tightening the sleeve about the shaft with some narrowing of gap 68. The teeth of gear 28 are precisely located in a rotational sense with respect to the hook point 74 of the rotating looptaker 26 by the engagement of screw 30 with planar surface 70, and the gear is prevented thereby from slipping around the sleeve to alter the timing of the looptaker relative to a needle during the operation of a sewing machine. Sleeve 31 is of steel or other hard resilient material highly resistant to local deformation under pressure.

The sleeve by distrubuting the force applied by screw 30 around the periphery of hollow shaft 24 prevents indentation of the shaft by the screw, and so permits the use of a greater variety of materials in the construction of the shaft than heretofor possible. More particularly, by reason of the described arrangement, it is now possible, for example, to select a light weight material which can be cast such as zinc or an inexpensive molded plastic for use, and to form the depending shaft 24 and rotary looptaker 26 in a mold with such materials as an integral structure requiring little or no machining.

It is to be understood that the present disclosure relates to a preferred embodiment of the invention which is for purposes of illustration only and is not to be construed as limiting the invention. Numerous alterations and modifications of the structure herein will suggest themselves to those skilled in the art, and all such modifications and alterations which do not depart from the spirit and scope of the invention are intended to be included within the scope of the appended claims.

I claim:

1. In combination, a looptaker for a sewing machine, a hollow drive shaft for the looptaker depending therefrom, a spindle rotatable within the hollow drive shaft, a sleeve on the hollow shaft with a slit extending throughout the length thereof and including an interior flat surface in engagement with an exterior flat surface provided on the drive shaft to prevent relative rotation of the sleeve and shaft, and a gear affixed to the sleeve with a set screw extending through the gear and bearing against an exterior surface on the sleeve to contract the entire sleeve about the drive shaft, the looptaker and shaft being integral and of a cast material, and the sleeve being of a resilient material which is more resistant to local deformation by applied pressure than the material of said looptaker and shaft.

2. The combination of claim 1 wherein the looptaker and shaft are a one-piece cast zinc part.

3. The combination of claim 1 wherein the looptaker and shaft are a one-piece molded plastic part.

4. The combination as set forth in claim 3 wherein the sleeve is of a resilient steel.

* * * * *